US011033129B2

(12) United States Patent
Diaz

(10) Patent No.: US 11,033,129 B2
(45) Date of Patent: Jun. 15, 2021

(54) CONVERTIBLE TRAVEL ACCESSORY

(71) Applicant: William Diaz, Sleepy Hollow, NY (US)

(72) Inventor: William Diaz, Sleepy Hollow, NY (US)

( * ) Notice: Subject to any disclaimer, the term of this patent is extended or adjusted under 35 U.S.C. 154(b) by 0 days.

(21) Appl. No.: 16/786,090

(22) Filed: Feb. 10, 2020

(65) Prior Publication Data

US 2020/0253397 A1 Aug. 13, 2020

Related U.S. Application Data

(60) Provisional application No. 62/803,839, filed on Feb. 11, 2019, provisional application No. 62/820,545, filed on Mar. 19, 2019.

(51) Int. Cl.

| | |
|---|---|
| ***A47G 9/10*** | (2006.01) |
| ***A47G 9/02*** | (2006.01) |
| ***A47C 7/38*** | (2006.01) |

(52) U.S. Cl.

CPC ..... *A47G 9/1081* (2013.01); *A47C 7/383* (2013.01); *A47G 9/0207* (2013.01); *A47G 9/1045* (2013.01)

(58) Field of Classification Search

CPC ..... A47G 9/1081; A47G 9/0207; A47G 9/10; A47G 2009/1018; A47G 9/1045; A47G 9/1072; A47G 9/109; A47G 9/0223; A47G 9/0253; A47C 7/383; A47C 7/38

USPC ..... 5/636, 637, 639, 640, 490

See application file for complete search history.

(56) References Cited

U.S. PATENT DOCUMENTS

| | | | | |
|---|---|---|---|---|
| 3,729,745 | A | 5/1973 | Latina | |
| 4,590,633 | A * | 5/1986 | Pickens | A47G 9/0207 446/369 |
| 4,617,691 | A | 10/1986 | Monti et al. | |
| 4,754,512 | A * | 7/1988 | Chao-Yang | A47D 15/003 446/226 |
| 5,815,833 | A | 10/1998 | Kuo | |
| 6,112,333 | A | 9/2000 | Mazzei | |
| 6,651,256 | B1 | 11/2003 | Swift | |
| 6,973,691 | B1 | 12/2005 | Cardova et al. | |
| 7,657,954 | B1 * | 2/2010 | Bunkers | A42B 1/048 5/644 |

(Continued)

FOREIGN PATENT DOCUMENTS

CN 204950333 1/2016

OTHER PUBLICATIONS

'Grand Trunk Hooded Travel Pillow' (Grand Trunk) Jun. 9, 2015 (Jun. 9, 2015) [online] retrieved from <URL: https:/twww.amazon.com/Grand-Trunk-Blackout-Hooded-APiflow/dp/B009CSMGSK/ref=sr_1_8?dchild=1&keywords=neck%2Bpillow%2Bwith%2Bhood&qid=1586456870&sr=8-8&th=1 >entire document.

High Sierra, "High Sierra HS1369 \ Hoodie Travel Pillow \ Block Out Light \ Sleep Deeper on Flights & Road Trips \ 100% Pure Memory Foam \ Helps Relieve Neck Discomfort \ Provides Exceptional Neck Support", Retrieved from the Internet <URL:https://www.amazon.com/High-Sierra-HS1369-Discomfort-Exceptional/dp/B07KDQMFKM/ref=cm_cr_arp_d_product_top?ie=UTF8>, Jan. 21, 2019.

(Continued)

*Primary Examiner* — Robert G Santos

(74) *Attorney, Agent, or Firm* — Leason Ellis LLP

(57) ABSTRACT

A convertible travel accessory in accordance with one embodiment includes a main body that in a first state assumes a hoodie form for being worn on a head of a user and in a second state assumes a storage pouch form. The travel accessory also includes a chin pillow that is coupled to and adjustable relative to the main body for placement beneath a chin of a user, wherein in the second state, the chin pillow is inserted into the storage pouch. An optional blanket can also be provided as part of the travel accessory and can be permanently attached to the chin pillow (e.g., along a bottom edge thereof) or it can be detachably coupled to the chin pillow.

17 Claims, 6 Drawing Sheets

(56) References Cited

U.S. PATENT DOCUMENTS

| | | | | |
|---|---|---|---|---|
| D685,161 | S | 7/2013 | Sun | |
| 8,726,421 | B2 | 5/2014 | Alvarez | |
| 8,864,544 | B2 * | 10/2014 | Anderman | A63H 3/003 |
| 8,990,980 | B1 * | 3/2015 | Hindley | A61G 7/072 5/490 |
| 9,439,463 | B1 | 9/2016 | Spears | |
| D781,028 | S | 3/2017 | Hindley | |
| 10,265,636 | B2 * | 4/2019 | Anderman | A63H 3/02 |
| 10,390,623 | B2 * | 8/2019 | Konigsberg | A47G 9/066 |
| 10,743,687 | B2 * | 8/2020 | Doty | A47G 9/1027 |
| 10,863,826 | B1 * | 12/2020 | Schneider | A47C 7/383 |
| 2006/0053556 | A1 | 3/2006 | Piontek | |
| 2008/0250550 | A1 | 10/2008 | Bologna et al. | |
| 2010/0043117 | A1 | 2/2010 | Hildebrandt | |
| 2011/0088135 | A1 | 4/2011 | Snyder et al. | |
| 2012/0144550 | A1 | 6/2012 | Nejad | |
| 2012/0276802 | A1 | 11/2012 | Anderman et al. | |
| 2013/0061375 | A1 | 3/2013 | Bologna et al. | |
| 2013/0125312 | A1 | 5/2013 | Harooni | |
| 2015/0111459 | A1 * | 4/2015 | Anderman | A63H 3/003 446/27 |
| 2015/0257555 | A1 | 9/2015 | Wong | |
| 2017/0027346 | A1 * | 2/2017 | Konigsberg | A47C 7/383 |
| 2017/0086607 | A1 | 3/2017 | Wong et al. | |
| 2017/0224033 | A1 | 8/2017 | Latta, Jr. | |
| 2017/0251813 | A1 | 9/2017 | Komsky et al. | |
| 2017/0258154 | A1 | 9/2017 | Peyser | |
| 2018/0360242 | A1 * | 12/2018 | Doty | A42B 1/041 |
| 2020/0077819 | A1 * | 3/2020 | Thibodeau | A41D 15/04 |
| 2020/0113339 | A1 * | 4/2020 | Dassi | A42B 1/006 |
| 2020/0253397 | A1 * | 8/2020 | Diaz | A47C 7/383 |

OTHER PUBLICATIONS

Qualid LLC, "Qualid Travel Pillow with Hoodie—Ultra Soft Comfort, Strong Neck Support, Guaranteed Sleep with Light Blocking Hoodie, Travel and Home Use, Premium Memory Foam, Adjustable, One Size Fits All", Retrieved from the Internet <URL:https://www.amazon.com/dp/B07VD5PJDF/ref=psdc_3732121_t1_B07KDQMFKM>, Aug. 10, 2019.

Sunany, "Neck Pillow Inflatable Travel Pillow Comfortably Supports the Head, Neck and Chin, Airplane Pillow with Soft Velour Cover, Hat, Portable Drawstring Bag, 3D Eye Mask and Earplugs (Grey)", Retrieved from the Internet <URL:https://www.amazon.com/Inflatable-Comfortably-Supports-Airplane-Drawstring/dp/B07PVDR63S>, Aug. 14, 2019.

HoodiePillow, "HoodiePillow Memory Foam Travel Pillow (Charcoal)", Retrieved from the Internet <URL:https://www.amazon.com/dp/B07TJZKDX8/ref=psdc_3732121_t3_B07KDQMFKM> , Aug. 8, 2017.

HoodiePillow, "HoodiePillow Inflatable Neck Pillow for Airplane Travel, Car, Train or Relaxing at Home. Compact, Comfortable for Your Neck and Includes Privacy Hood—Black", Retrieved from the Internet <URL:https://www.amazon.com/dp/B076CPN5PK/ref=psdc_3732121_t4_B07KDQMFKM >, Oct. 28, 2014.

Trtl, "Trtl Pillow—Scientifically Proven Super Soft Neck Support Travel Pillow—Machine Washable (Grey)", Retrieved from the Internet <URL:https://www.amazon.com/dp/B00LB7REFK/ref=psdc_3732121_t5_B07KDQMFKM>, Reference is believed to predate application priority date.

* cited by examiner

CONVERTIBLE TRAVEL ACCESSORY

CROSS-REFERENCE TO RELATED PATENT APPLICATIONS

This application is based on and claims priority to U.S. Provisional Patent Application No. 62/803,839, filed Feb. 11, 2019 and U.S. Provisional Patent Application No. 62/820,545, filed Mar. 19, 2019, all of which are incorporated by reference, as if expressly set forth in their respective entireties herein.

TECHNICAL FIELD

The present invention relates to travel accessories and more particularly, relates to a travel accessory that is convertible between a pouch and a hoodie that that has a chin pillow along with an optionally blanket.

BACKGROUND

There are a wide assortment of accessories that are available to travelers with many of the more popular accessories incorporating a pillow, such as a neck pillow, that can be worn as during a flight on an airplane. This very popular travel accessory is essentially a U-shaped pillow that is worn around the traveler's neck with coverage being along the back of the neck and the sides of neck. This is intended to allow the traveler to relax his or her head backwards and have neck support due to the presence of the pillow. If the traveler's head nods to the left or right, the neck pillow provides some support as well. However, these neck pillows provide no support when the traveler's head nods forward. In this forward nod position, the head is not supported by the pillow.

It is therefore desirable and there is a need for a travel accessory that not only provides coverage over the eyes to allow rest by the traveler but also provides support to the traveler's head in the event that the head nodes forward during sleep.

SUMMARY

A convertible travel accessory in accordance with one embodiment includes a main body that in a first state assumes a hoodie form for being worn on a head of a user and in a second state assumes a storage pouch form. The travel accessory also includes a chin pillow that is coupled to and adjustable relative to the main body for placement beneath a chin of a user, wherein in the second state, the chin pillow is inserted into the storage pouch. An optional blanket can also be provided as part of the travel accessory and can be permanently attached to the chin pillow (e.g., along a bottom edge thereof) or it can be detachably coupled to the chin pillow.

BRIEF DESCRIPTION OF THE DRAWING FIGURES

DETAILED DESCRIPTION OF CERTAIN EMBODIMENTS

FIGS. 1-8 illustrate a travel accessory 100 in accordance with a first embodiment of the present invention. The travel accessory 100 is configured to be used during travel, such as when traveling on a bus, train or airplane.

Figure 8:
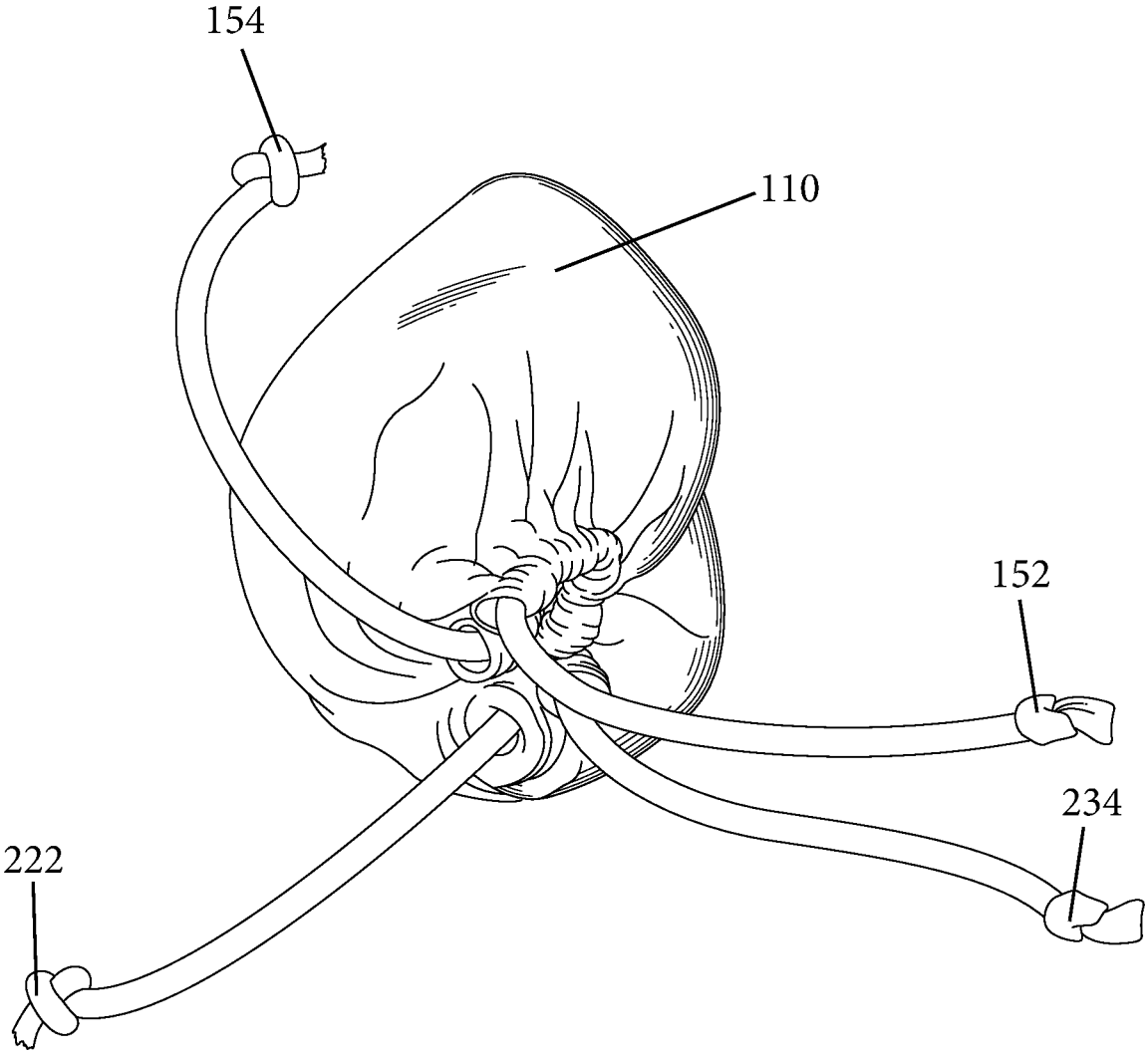
FIG. 8 is a perspective view of the travel accessory with drawing strings tightened to form the fully enclosed carry pouch.

FIG. 8 illustrates the travel accessory 100 in a first position which can be considered a storage position. In the storage position, the travel accessory 100 has a pouch like appearance in that it is defined by a first body (first part) 110 that preferably is a piece of fabric that is folded so as to define an interior space that receives and holds other parts of the travel accessory as described herein. As described in more detail below, a peripheral edge of the first part 110 can be tightened/gathered as, for example, by cinching action. As described herein, one more cinching elements can used to reduce the size of the peripheral edge of the first part 110 so to restrict and close off the entrance to the interior space of the pouch, thereby closing off the first part 110. It will be appreciated that while the pouch defined by the first part 110 is described as containing and holding other parts that are integral and a part of the travel accessory, other unrelated objects can be placed into this interior space. In this way, the pouch defined by the first part 110 functions like any traditional pouch (closeable bag) or satchel. For example, personal objects, like glasses or earplugs, can be placed within the interior space.

Figure 1:
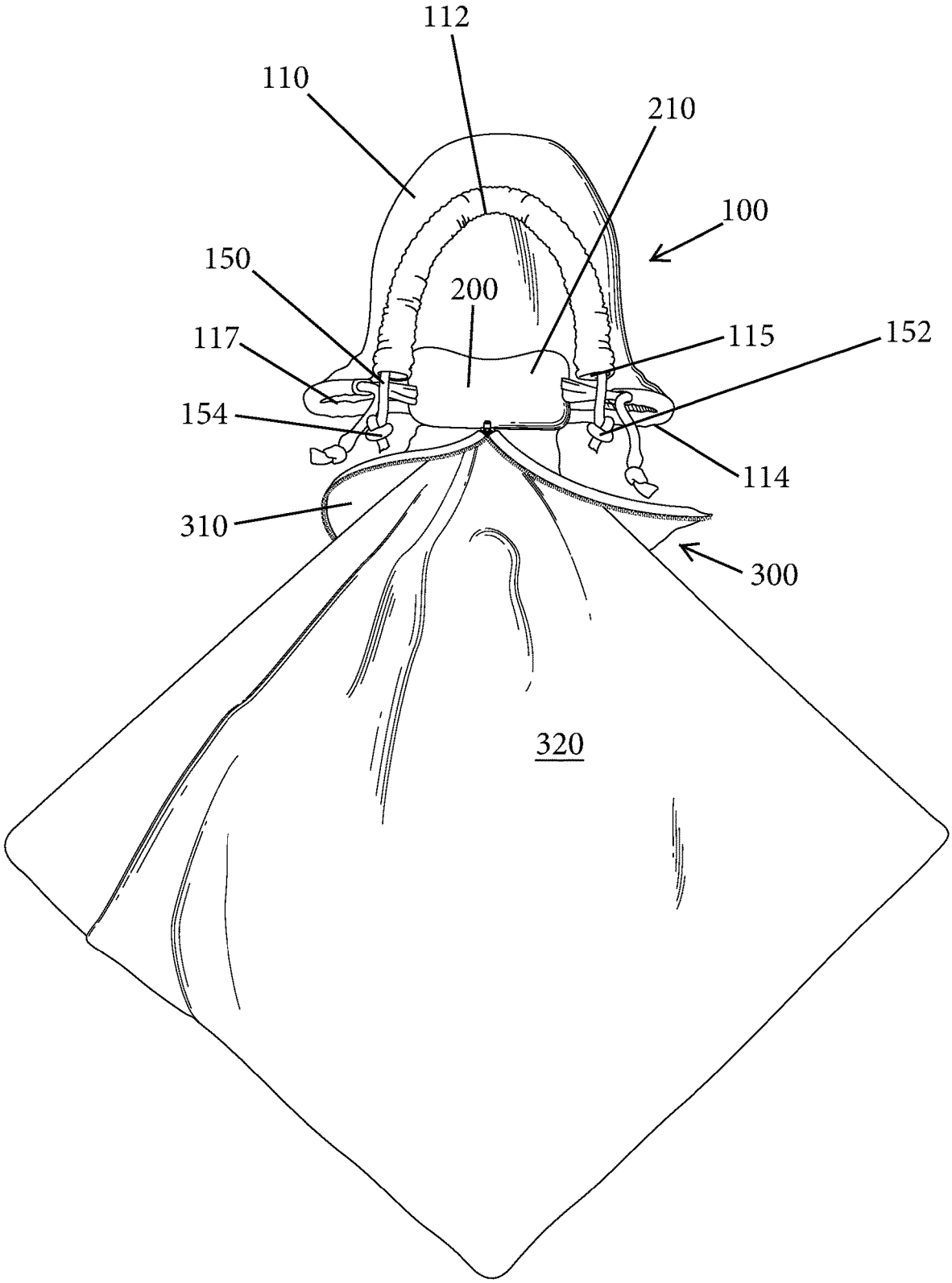
FIG. 1 is front elevation view of a travel accessory according to a first embodiment of the present invention and shown with an optional blanket in an unfolded condition.

FIGS. 1-8 show the travel accessory 100 in various states with FIG. 1 being an in-use position, which as described herein is configured to be worn over a user's head and provide chin support to allow the user to nod forward as in a rest or sleeping position.

In accordance with one embodiment of the present invention, the first part 110 comprises a piece of fabric having a first edge 112 and an opposite second edge 114. The first edge 112 is a folded edge in that the fabric at first edge 112 is folded over on top of itself and secured to itself, as by stitching, so as to define a first channel 115 defined within the first folded over edge 112. Similarly, the second edge is a folded edge in that the fabric at second edge 114 is folded over on top of itself and secured to itself, as by stitching, so as to define a second channel 117 defined within the second folded over edge 114.

In the closed storage position of the first part 110, the first and second edges 112, 114 are drawn to one another so to generally define a circular shaped peripheral edge that completes the interior space and defines the pouch like structure in the storage position.

The first part 110 not only defines the body of the pouch in the storage position, but when the first part 110 is inverted to a second (in-use) position, it defines a hood (hoodie) that can be worn over the traveler's head. When the first part 110 is in the form a hood, the first folded edge 112 represents a front edge of the hood and the second folded edge 114 represents a bottom edge of the hood. The front edge being the U-shaped edge that extends along the sides of the traveler's head along the top of the head, while the bottom edge is the edge that extends along the back of the neck of the traveler.

Open ends of the first channel 115 and the second channel 117 are proximate one another in the second (in-use) position shown in FIG. 1. A main strap 150 has a first end 152 and an opposite second end 154. The main strap 150 is fed through the first channel 115 such that the first end 152 is exposed at one end of the first channel 115 and the second end 154 is exposed at the other open end of the first channel 115. Each of the first end 152 and the second end 154 can be a knotted end to ensure that these ends 152, 154 remain outside of the first channel 115. Much like a winter coat or hoodie, when the two free ends 152, 154 are pulled downward away from the hoodie 110 and away from the ends of the channel 115, the folded material defining the first channel 115 is bunched.

The travel accessory 100 has a second part 200 that is in the form of a chin pillow or chin support structure that is configured to placed under the chin of the user. The second part 200 is thus defined by a chin support body 210 such as a chin pillow that can have come in any number of different shapes and sizes. For example, and as illustrated, the chin support body 210 can be a rectangular shaped pillow that has a first end 212 and a second end 214. The first end 212 can be considered to be the side for placement on the left side of the user's chin and the second end 214 can be considered to be the side for placement of the right side of the user's chin.

The chin support body 210 (pillow) can also have a contoured shape such as having a concave shaped top edge on which the user's chin rests.

Figure 7:
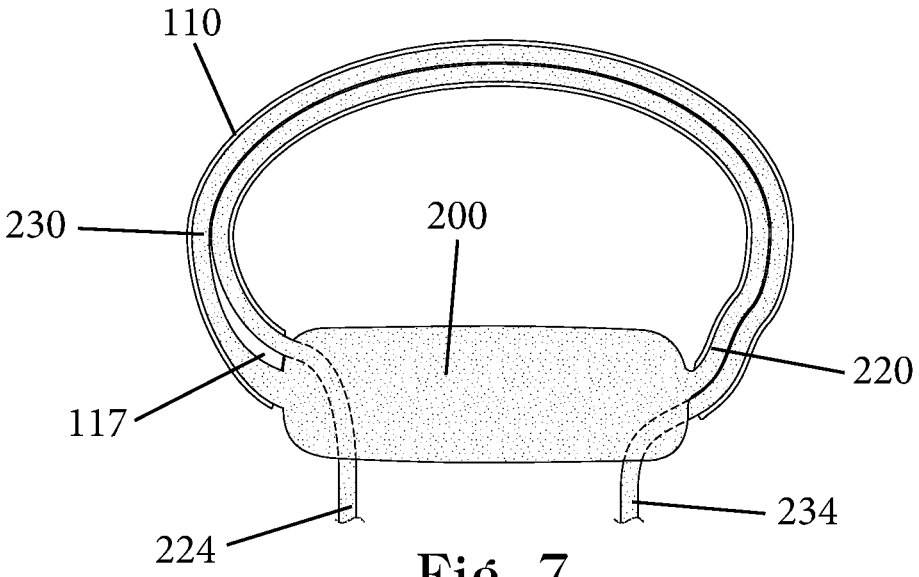
FIG. 7 is a cross-sectional view taken along the line 7-7 of FIG. 6.

The chin pillow 200 is coupled to the first part 110 (hoodie) in such a way that the user can easily adjust the chin pillow 200 and more specifically, the user can easily pull the chin pillow 200 away from the user's face to create a more than adequate space for the user's head to be received between the hoodie 110 and the chin pillow 200 as shown in FIG. 7. Once the user's head is received between the hoodie 110 and the chin pillow 200 with the head received within the hoodie 110, the user then draws the chin pillow 200 inward towards the user's face to position the chin pillow 200 below the chin.

In the illustrated embodiment, the chin pillow 200 is coupled to the first part 110 by a first chin strap 220 and a second chin strap 230. The first chin strap 220 includes a first end 222 that is fixedly attached to the first end 212 of the chin support body 210 and a second end 224 that is fed through the second channel 117 and exits the second channel 117 proximate the second end 224 of the chin support body 210. In other words, the first chin strap 220 enters the second channel 117 on the left side of the user's face and passes through the second channel 117 along the rear of the user's neck until it exits the open end of the second channel 117 that is at the right side of the user's face. The second end 224 thus represent a free end of the first chin strap 220 can be knotted to prevent the second end 224 from being accidently pulled into the second channel 117. This knotted second end 224 can thus be pulled in an outward direction away from the user' face (and chin) to cause the length of the first chin strap 220 that is exposed beyond the second channel 117 to increase. The result of this outward puling action of the first chin strap 220 is that the left side of the chin support body 210 where the first end 222 of the first chin strap 220 is attached to be drawn inward toward the user's face.

The second chin strap 230 includes a first end 232 that is fixedly attached to the second end 214 of the chin support body 210 and a second end 234 that is fed through the second channel 117 and exits the second channel 117 proximate the first end 212 of the chin support body 210. In other words, the second chin strap 230 enters the second channel 117 on the right side of the user's face and passes through the second channel 117 along the rear of the user's neck until it exits the open end of the second channel 117 that is at the left side of the user's face. The second end 234 thus represent a free end of the second chin strap 230 can be knotted to prevent the second end 234 from being accidently pulled into the second channel 117. This knotted second end 234 can thus be pulled in an outward direction away from the user' face (and chin) to cause the length of the second chin strap 230 that is exposed beyond the open end of second channel 117 to increase. The result of this outward puling action of the second chin strap 230 is that the right side of the chin support body 210 where the first end 232 of the second chin strap 230 is attached to be drawn inward toward the user's face.

When the user wishes to remove the travel accessory 100, the user simply pulls the chin pillow 200 in a direction away from the face, thereby increasing the space between the chin pillow 200 and the hoodie 110 allowing the user's head to pass through this space as the travel accessory 100 is raised relative to the user's head for removal thereof.

It will be appreciated that the free second ends 224, 234 of the first chin strap 220 and the second chin strap 230 are used to convert the hoodie 110 into the pouch storage position shown in FIG. 8. In other words, to convert the travel accessory 100 into the storage pouch of FIG. 8, the free second ends 224, 234 are pulled and act as a cinching mechanism as described below, thereby causing the material forming the second channel 117 to bunch. The convertible nature of the travel accessory 100 is further described below.

Figure 2:
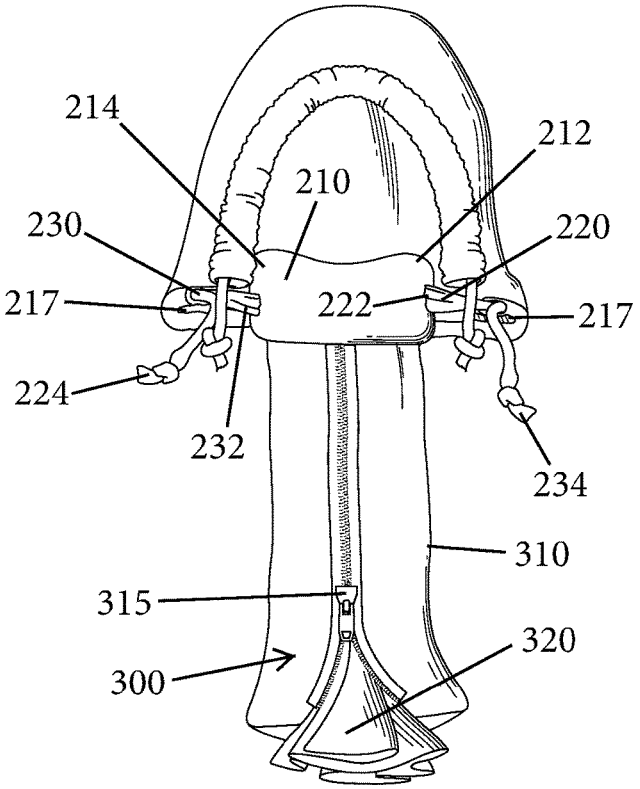
FIG. 2 is a front elevation view of the travel accessory with the blanket in a folded condition and shown as being permanently attached to a chin pillow.
Figure 3:
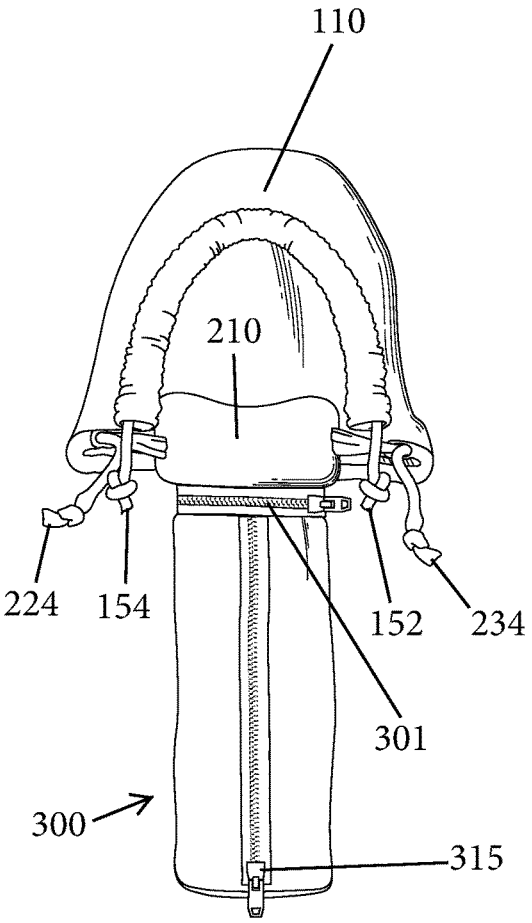
FIG. 3 is a front elevation view of the travel accessory with the blanket in the folded condition and shown as being detachably coupled to the chin pillow.

The travel accessory 100 also includes an optional blanket 300. The blanket 300 can be permanently attached to the chin pillow 200 as shown in FIG. 2 or the blanket 300 can be detachably coupled to the chin pillow 200 as shown in FIG. 3. In the case in which the blanket 300 is detachably coupled to the chin pillow 200 (FIG. 3), a fastener mechanism can be used to achieve such arrangement. For example, one or more fasteners 301 can be provided for detachably coupling the blanket 300 to the chin pillow 200. Any number of different types of fasteners 301 can be used including but not limited to a zipper (as shown), snaps, buttons, hook and loop material, etc. In this way, if the user wishes to detach the blanket 300 from the chin pillow 200, the user simply unfastens the fastener 301 to detach the blanket 300 from the chin pillow 200.

The optional blanket 300 can also be provided in the form of an openable and closable pouch (outer shell) 310 as shown in FIGS. 1-3. The pouch 310 can include a fastener 315 for opening and closing the pouch 310. The fastener 315 can include any number of different types of fasteners, including but not limited to a zipper (as shown), snaps, buttons, hook and loop material, etc. When the fastener 315 is opened, the pouch 310 is opened to expose a main portion 320 of the blanket 300 that can be unfolded from the pouch 310 as shown in FIG. 1. As shown, the pouch 310 can have two halves (shell construction) that open along a middle portion as by the fastener 315 to allow the main portion 310 to be folded out of the open pouch 310. When unfolded, the blanket 300 can have diamond shape with one corner being attached to the inside of the pouch 310 such that when the blanket 300 is unfolded, the other three corners of the blanket 300 are exposed.

It will be appreciated that the fastener 315 is illustrated as facing away from the user's head (body); however, this is merely one location of the fastener 315 and instead, the fastener 315 can be on the opposite face of the pouch 310 in that it can face inward toward to the user's body.

During use when the travel accessory 100 is worn on the user's head with the chin pillow 200 positioned below the chin, the blanket 300 will unfold out over the user's lap for providing travel comfort.

Once the use of the blanket 300 is complete, the blanket 300 is folded back into the inside of the pouch 310 and then the fastener 315 is fastened to close up the pouch 310.

Figure 6:
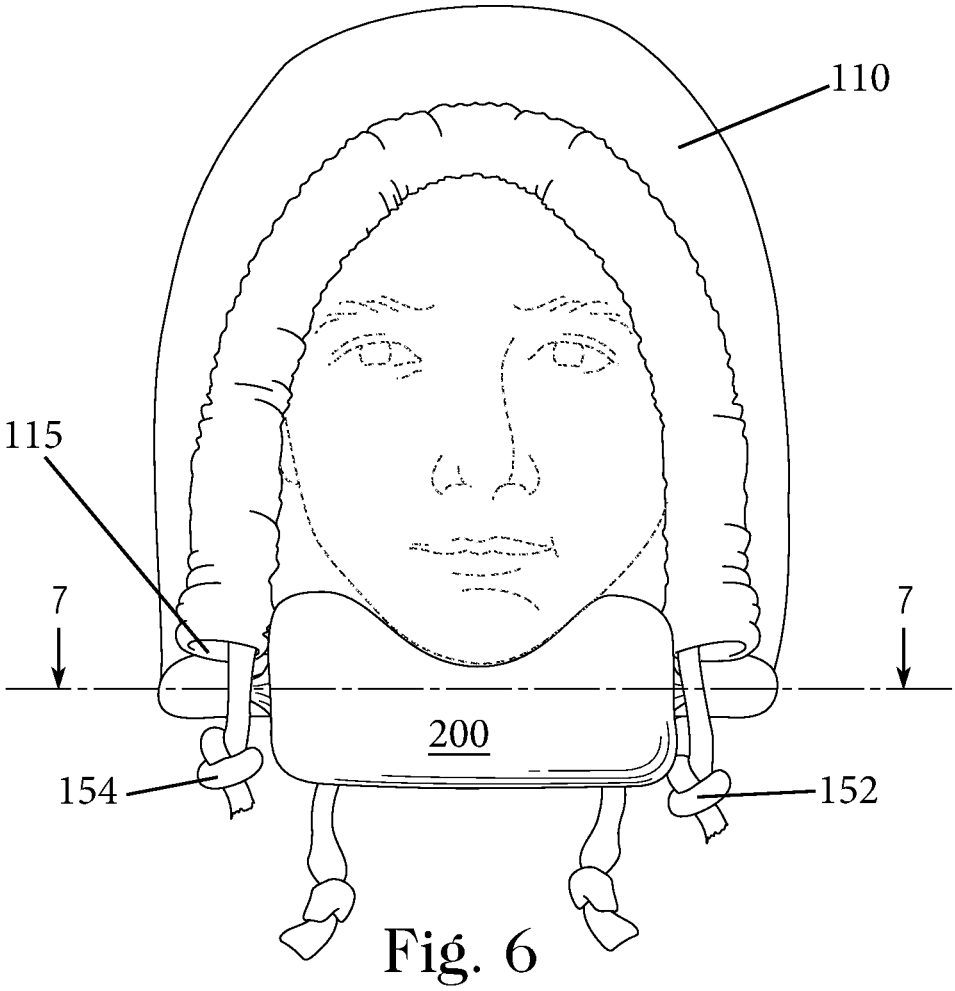
FIG. 6 is a front elevation view of the travel accessory in an in-use position.

FIGS. 6 and 7 show the travel accessory 100 in use with a head of the user being shown. As shown in FIG. 7, the head is received between the chin pillow 200 and the rear of the hoodie.

It will also be appreciated that other features can be incorporated into the chin pillow 200 such as battery powered heating elements, massage elements, etc. Also, the chin pillow can be formed of two or more materials, such as a core and an outer covering.

Figure 4:
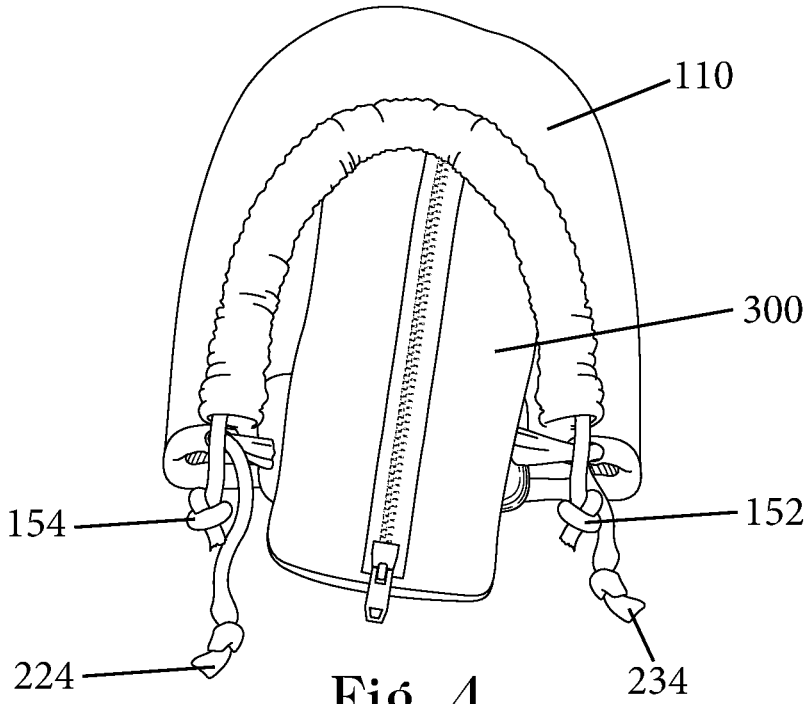
FIG. 4 is a front elevation view of the travel accessory with the optional blanket being partially inserted into a main hoodie portion of the travel accessory to create a carry pouch.
Figure 5:
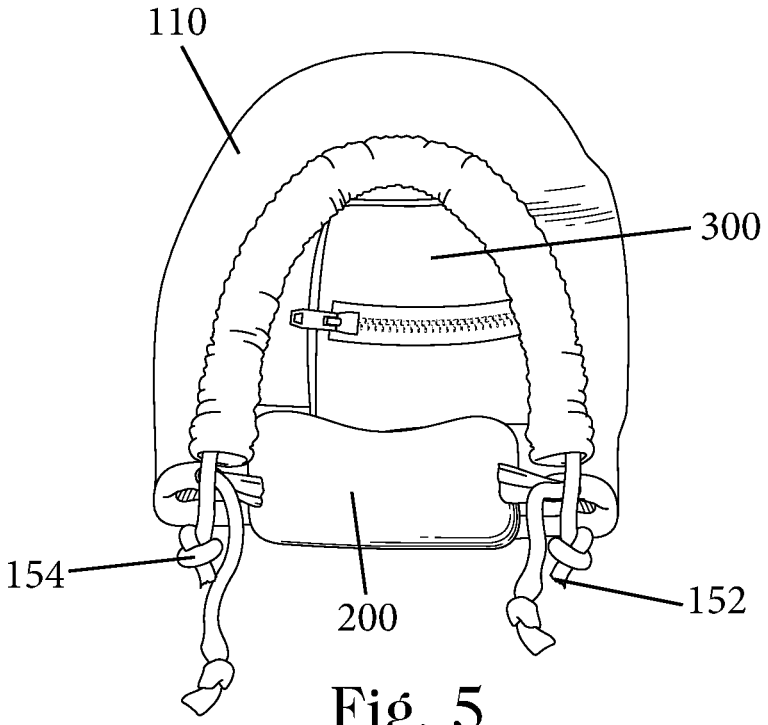
FIG. 5 is a front elevation view of the travel accessory with the optional blanket fully inserted into the main hoodie portion.

FIGS. 4-5 shows a method of converting the travel accessory 100 into the pouch. The blanket 300 is folded up on top of the chin pillow 200 into the interior of the hoodie 110. The chin pillow 200 itself is drawn into the interior of the hoodie 110. To form the pouch shown in FIG. 8, the free ends 152, 154 of the main strap 150 and the free ends 224, 234 of the chin straps 220, 230 are pulled outward to cinch the material that forms the hoodie 110. In this fully cinched condition of FIG. 8, the chin pillow 200 and the blanket 300 are fully contained in the closed pouch and only the material of the hoodie 110 is visible. As mentioned herein, other objects, beyond the pillow 200 and blanket 300, can be inserted into the pouch.

Figure 9:
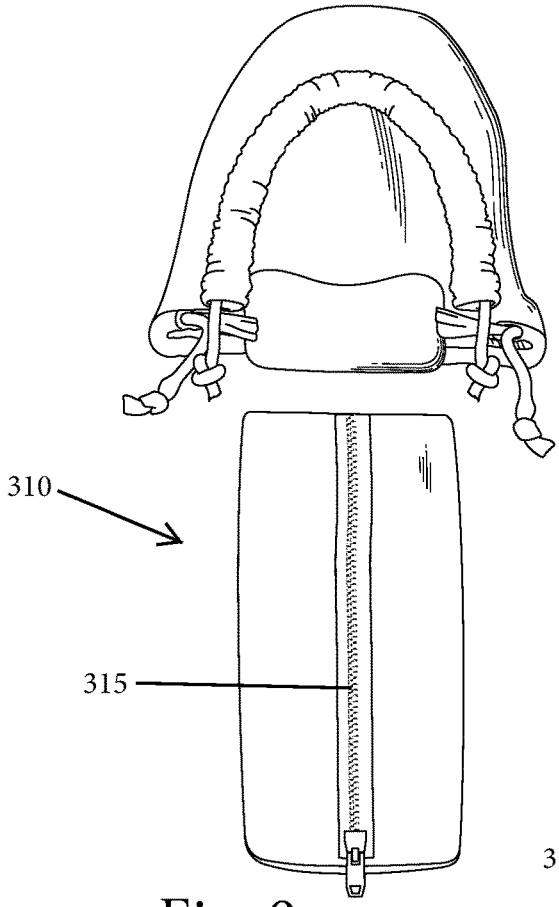
FIG. 9 is a front elevation view of a travel accessory with a detachable pillow pouch.
Figure 10:
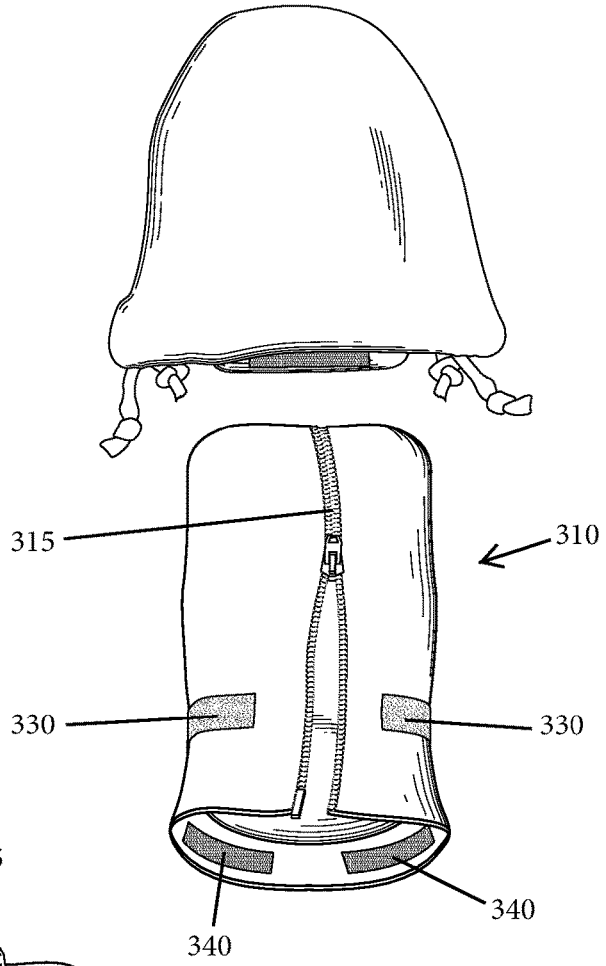
FIG. 10 is rear elevation view of a travel accessory with a detachable pillow pouch.
Figure 11:
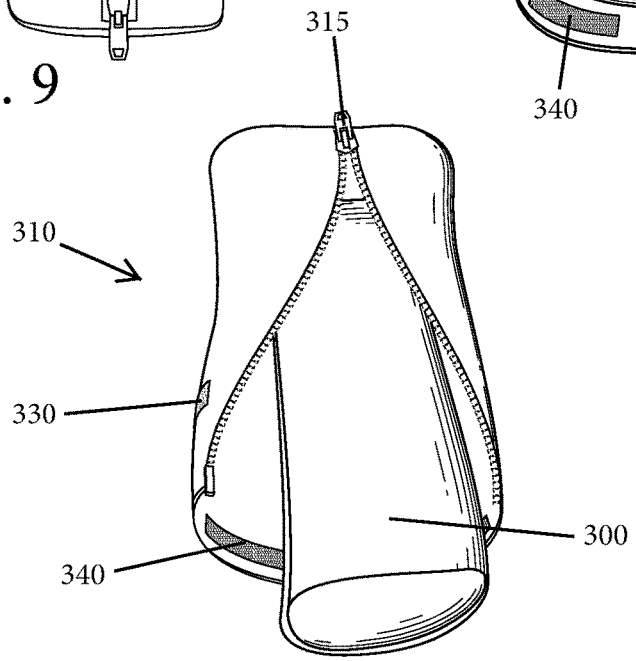
FIG. 11 is a front elevation view of the pillow pouch in an open state.

FIG. 9 depicts another embodiment in which an alternative blanket construction is shown. In particular, blanket pouch 310 is formed of two halves (two end portions of a common piece of fabric) that folds generally in half to define the pouch 310 as shown. FIG. 9 shows the blanket pouch 310 with a forward-facing fastener 315, while FIGS. 10-11 show a rearward-facing fastener 315. In FIG. 9, the blanket pouch 310 open forward, while in FIGS. 10-11 show the blanket pouch 310 opening rearward.

One part of the fastener 315 is formed along one side edge (at a first end) of the pouch, while the other part of the fastener 315 is formed at the other side edge (at a second end) of the pouch. When these two fastener parts are joined, an enclosure structure is formed (since both ends of the fabric are folded over toward each other). As shown, the pouch includes a pair of second fasteners 330 with one second fastener position proximate one fastener part 315 and the other second fastener 330 being proximate the other fastener part 315. The pair of second fasteners 330 can be hook and loop patches or any number of other types of fasteners. This pair of second fasteners 330 do not mate with each other but mate with a pair of third fasteners 340 also provided on the pouch 310. The pair of second fasteners 330 is formed on one surface (e.g., outer blanket pouch surface shown in FIG. 10), while the pair of third fasteners 340 is formed on the other surface (e.g., inner surface of the pouch as shown in FIG. 10). The two ends of the pouch 310 are joined by fastener 315 (to form an enclosed pouch with an open bottom) and then the bottom fabric is folded up to place the pair of third fasteners 340 into contact with the second fasteners 330 so as to close off the bottom of the pouch and partially cover the fastener 315 as shown in the figures.

The second and third fasteners 330, 340 are not limited to being hook and loop material but can be any of the fasteners mentioned herein and other conventional ones.

In addition, the blanket itself can be removable from the blanket pouch 310 as for example, by having fasteners at a top end of the blanket that removably mate with fasteners on the pouch. Any of the fasteners described herein can be used, such as hook and loop material. This allows the blanket to be detached from the pouch 310 and the hoodie and chin pillow. In an alternative embodiment, the blanket can have hook and loop fasteners that mate with complementary hook and loop fasteners that are inside the blanket pouch.

What is claimed is:

1. A convertible travel accessory comprising:

a main body that in a first state assumes a hoodie form for being worn on a head of a user and in a second state assumes a storage pouch form; and a chin pillow that is substantially spaced apart from and disposed between sides of the main body and is coupled to and adjustable relative to the main body for placement beneath a chin of a user, wherein in the second state, the chin pillow is inserted into the storage pouch.

2. A convertible travel accessory comprising:

a main body that in a first state assumes a hoodie form for being worn on a head of a user and in a second state assumes a storage pouch form; and a chin pillow that is coupled to and adjustable relative to the main body for placement beneath a chin of a user, wherein in the second state, the chin pillow is inserted into the storage pouch;

wherein the hoodie includes a first enclosed channel and a second enclosed channel, wherein the chin pillow is coupled to the main body through the second enclosed channel.

3. The travel accessory of claim 2, wherein in the first state, the first enclosed channel is configured for placement along sides of the head and along a forehead of the head and the second enclosed channel is configured for placement along the two sides of the head and along a rear of the head.

4. The travel accessory of claim 2, wherein the first enclosed channel includes a main strap that has free first and second ends that are positioned outside respective first and second open ends of the first channel.

5. The travel accessory of claim 2, wherein the chin pillow has a first chin strap that is fixedly attached to a first end of the chin pillow and enters a first end of the second enclosed channel and passes through the second enclosed channel until exiting from a second end thereof, wherein the chin pillow has a second chin strap that is fixedly attached to a second end of the chin pillow and enters the second end of the second enclosed channel and passes through the second enclosed channel until exiting from the first end thereof.

6. A convertible travel accessory comprising:
a main body that in a first state assumes a hoodie form for being worn on a head of a user and in a second state assumes a storage pouch form;
a chin pillow that is coupled to and adjustable relative to the main body for placement beneath a chin of a user, wherein in the second state, the chin pillow is inserted into the storage pouch; and
a blanket that is coupled to the chin pillow and configured to be folded into the storage pouch in the second state of the main body.

7. The travel accessory of claim 6, wherein the blanket is detachably coupled to a bottom edge of the chin pillow.

8. The travel accessory of claim 7, wherein the blanket is detachably coupled to the bottom edge with a first fastener.

9. The travel accessory of claim 8, wherein the first fastener is selected from the group consisting of: a zipper, snaps, button, and hook and loop material.

10. The travel accessory of claim 6, wherein the blanket has an outer shell portion and a main blanket portion that is contained within the outer shell portion in a storage state.

11. The travel accessory of claim 10, wherein the outer shell portion has a second fastener for closing the outer shell portion, whereby when the outer shell portion is closed, the main blanket portion is fully contained within the outer shell portion.

12. The travel accessory of claim 11, wherein the second fastener is selected from the group consisting of: a zipper, snaps, button, and hook and loop material.

13. A convertible travel accessory comprising:
a main body that in a first state assumes a hoodie form for being worn on a head of a user and in a second state assumes a storage pouch form;
a chin pillow that is coupled to and adjustable relative to the main body for placement beneath a chin of a user, wherein in the second state, the chin pillow is inserted into the storage pouch while maintaining its coupling to the main body; and
a blanket that is coupled to the chin pillow and can be positioned between a closed position and an open position, wherein in the second state, the blanket is inserted into the storage pouch while maintaining its coupling to the chin pillow.

14. The travel accessory of claim 13, wherein the blanket is disposed within a blanket pouch that is detachably coupled to the chin pillow, the blanket pouch having an open position in which the blanket can be removed and a closed position.

15. The travel accessory of claim 14, wherein the blanket pouch includes a foldable body with an open bottom end, the blanket pouch including a main fastener for joining two sides of the foldable body and a secondary fastener for closing the open bottom end of the foldable body.

16. The travel accessory of claim 15, wherein the main fastener comprises a zipper and the secondary fastener comprises a first set of hook and loop patches formed along an inside face of the foldable body and a second set of hook and loop patches formed along an outside of the foldable body for mating with the first set of hook and loop patches to close off the bottom end.

17. The travel accessory of claim 14, wherein the blanket is free of fixed attachment to the blanket pouch and can be freely removed therefrom.

* * * * *